US006983927B2

(12) United States Patent
Pelletier et al.

(10) Patent No.: US 6,983,927 B2
(45) Date of Patent: Jan. 10, 2006

(54) LEVEL WIND APPARATUS FOR USE ON A SNOW GROOMING VEHICLE

(75) Inventors: Michel Pelletier, Canton de Shefford (CA); Claude Trahan, St-Jean-sur-Richelieu (CA)

(73) Assignee: Camoplast Industrial Inc., Sherbrooke (CA)

( * ) Notice: Subject to any disclaimer, the term of this patent is extended or adjusted under 35 U.S.C. 154(b) by 1 day.

(21) Appl. No.: 10/679,336

(22) Filed: Oct. 7, 2003

(65) Prior Publication Data

US 2004/0069981 A1 Apr. 15, 2004

Related U.S. Application Data

(60) Provisional application No. 60/416,534, filed on Oct. 8, 2002.

(51) Int. Cl.
*B66F 1/00* (2006.01)

(52) U.S. Cl. ..... 254/385; 254/323; 254/326; 254/327; 254/335; 254/336; 242/548.1; 242/397.3

(58) Field of Classification Search ..... 254/385, 254/323, 326, 327, 335, 336; 242/548.1, 242/397.1, 397.2, 397.3, 397, 276–279
See application file for complete search history.

(56) References Cited

U.S. PATENT DOCUMENTS

| | | | | | |
|---|---|---|---|---|---|
| 336,092 | A | * | 2/1886 | Crandal | 242/277 |
| 752,786 | A | * | 2/1904 | Leaver | 242/277 |
| 969,598 | A | * | 9/1910 | Buttles | 242/389 |
| 1,120,172 | A | * | 12/1914 | Trotter et al. | 242/397.3 |
| 1,172,418 | A | * | 2/1916 | Wolfe | 242/397.2 |
| 1,438,007 | A | * | 12/1922 | Welch | 242/277 |
| 1,448,786 | A | * | 3/1923 | Breen | 242/276 |
| 1,521,229 | A | * | 12/1924 | Clickner | 242/277 |
| 1,635,629 | A | * | 7/1927 | Marcy | 242/276 |
| 2,514,929 | A | * | 7/1950 | Brandt | 242/476.7 |
| 2,933,264 | A | * | 4/1960 | Jefferson et al. | 242/157.1 |
| 3,598,334 | A | * | 8/1971 | Fleischer | 242/277 |
| 3,889,896 | A | * | 6/1975 | O'Hara | 242/386 |
| 4,015,798 | A | * | 4/1977 | Benya | 242/157.1 |
| 4,799,628 | A | * | 1/1989 | Watanabe et al. | 242/277 |
| 2004/0021031 | A1 | * | 2/2004 | Klaus | 242/483.8 |

* cited by examiner

*Primary Examiner*—Emmanuel Marcelo
(74) *Attorney, Agent, or Firm*—Pillsbury Winthrop Shaw Pittman LLP

(57) ABSTRACT

A level winder is provided for winding cable in a winch system. The winch is suitable for use on a tracked vehicle, such as a snow grooming vehicle, to assist the vehicle in maneuvering on steep inclines. The level winder uses a pivoting pulley assembly to feed cable onto and off of a drum.

14 Claims, 5 Drawing Sheets

LEVEL WIND APPARATUS FOR USE ON A SNOW GROOMING VEHICLE

This application relies for priority on U.S. Provisional Patent Application Ser. No. 60/416,534, filed on Oct. 8, 2002, the contents of which are incorporated herein by reference.

BACKGROUND OF THE INVENTION

1. Field of the Invention

This invention relates to snow grooming vehicles that use winches to assist in climbing steep inclines. The invention is also directed to level winding systems for winch assemblies.

2. Description of Related Art

Tracked vehicles used in rugged terrain often employ winch assemblies to assist in maneuvering steep inclines. Snow grooming vehicles, for example, are sometimes equipped with winches that have cables that attach to fixed points on the incline to allow the vehicle to be anchored to the fixed point while sweeping up or down the slope. The cable anchor prevents the vehicle from turning over or sliding down the slope, which could occur on very steep inclines.

A winch-equipped vehicle typically carries a cable that extends outwardly through a rotatable boom. The boom is an elongated metal arm that guides the cable through a series of pulleys. Depending on the direction of intended travel, the boom is rotated to extend forwardly over the cab or to extend rearwardly away from the cab. The cable is typically carried on a drum, preferably a grooved drum, that is driven to control outlay and intake of the cable. A guide, preferably a level winder, is provided at the base of the boom to assist in aligning the cable as it is fed to and from the drum to prevent twisting of the cable.

Most prior art winches use vertical guides and worm gears that follow a linear path parallel to the drum's axis of rotation to align the cable with the drum grooves. As the load on the cable in such a system can be up to 10,000 lbs., the guide assembly must be constructed to accommodate such forces. These assemblies require a large degree of maintenance to prevent the guides and gears from rusting and breaking. However, constant lubrication is necessary. Additionally, these guide assemblies consume a large amount of space, which leaves limited space for the pulleys and rollers associated with the cable system. As a result, the diameter of the pulleys and rollers are often smaller than the minimum recommended cable bending radius. Bending cable about a radius less than the recommended bending radius shortens the life and reliability of the cable.

Some prior art systems use capstan systems to address the problems associated with the prior art guide assemblies described above. FIG. 5 illustrates a capstan system 100 that utilizes a linear guide system 110. The torque applied to the guide system 110 is reduced by winding cable 120 around a capstan 130. As a result, the force at the exit of the capstan 130 is a fraction, 1,000 lbs. for example, of the force in a conventional guide system. The cable 120 is guided from the capstan 130 through a sliding component 140 to a drum 150. However, the capstan 130 itself occupies a great deal of space and is complex, due in large part to the motors required for driving the capstan. Further, maintenance for a capstan is complicated as changing a cable requires a large investment of labor. Moreover, the sliding component 140 must be constantly lubricated.

Thus, there is a need for a less complex and more compact guide assembly associated with such a winch, especially a level winder assembly.

SUMMARY OF THE INVENTION

An aspect of embodiments of the invention is to provide a winch assembly that has a relatively compact and simple design.

Another aspect of embodiments of the invention is to provide a winch assembly suitable for use on a snow grooming vehicle and further to provide a snow grooming vehicle equipped with such a winch.

A further aspect of embodiments of the invention is to provide a winch that is relatively easy to operate, may allow an operator to observe operation, and may extend the useful life of the wound cable.

Among other things, the invention is directed to a winch assembly that includes a drum, a driver, and a level winder. The drum carries a length of cable. The driver is coupled to the drum and rotates the drum to wind and unwind the cable. The level winder is disposed adjacent to the drum to guide the cable with respect to the drum, and is supported to move in an arc shaped path.

The invention is also directed to a winch assembly that includes a drum, a driver, and a level winder. The drum carries a length of cable. The driver is coupled to the drum and rotates the drum about a generally horizontal axis to wind and unwind the cable. The level winder is disposed adjacent to the drum to guide the cable with respect to the drum. The level winder is also supported to pivot about a generally vertical axis.

The invention is also directed to vehicle that includes a frame, an engine that is supported by the frame, a drive mechanism that is operatively connected to the engine, and a winch assembly that is supported by the frame. The winch assembly includes a drum that carries a length of cable. A driver is coupled to the drum for rotating the drum to wind and unwind the cable. A level winder is disposed adjacent to the drum to guide the cable with respect to the drum. The level winder is supported to move in an arc shaped path.

These and other aspects of embodiments of the invention will become apparent when taken in conjunction with the following detailed description and drawings.

BRIEF DESCRIPTION OF THE DRAWINGS

Features of the invention are shown in the drawings, which form part of this original disclosure, in which.

DETAILED DESCRIPTION OF THE INVENTION

This invention is described for use on a tracked vehicle, particularly a snow grooming vehicle, for purposes of illustration only. However, the winch and level winder in accordance with embodiments of this invention may be used in any cable winding system. Further, the winch may be used on any type of vehicle, especially vehicles driven by rotatable tracks that may be driven over rugged terrain, such as steep inclines on mountains or ravines.

Throughout this description, reference is made to vertical and horizontal axes. It is understood that these axes are intended to refer to a vehicle position in which the vehicle is supported on a substantially horizontal surface.

Figure 1:
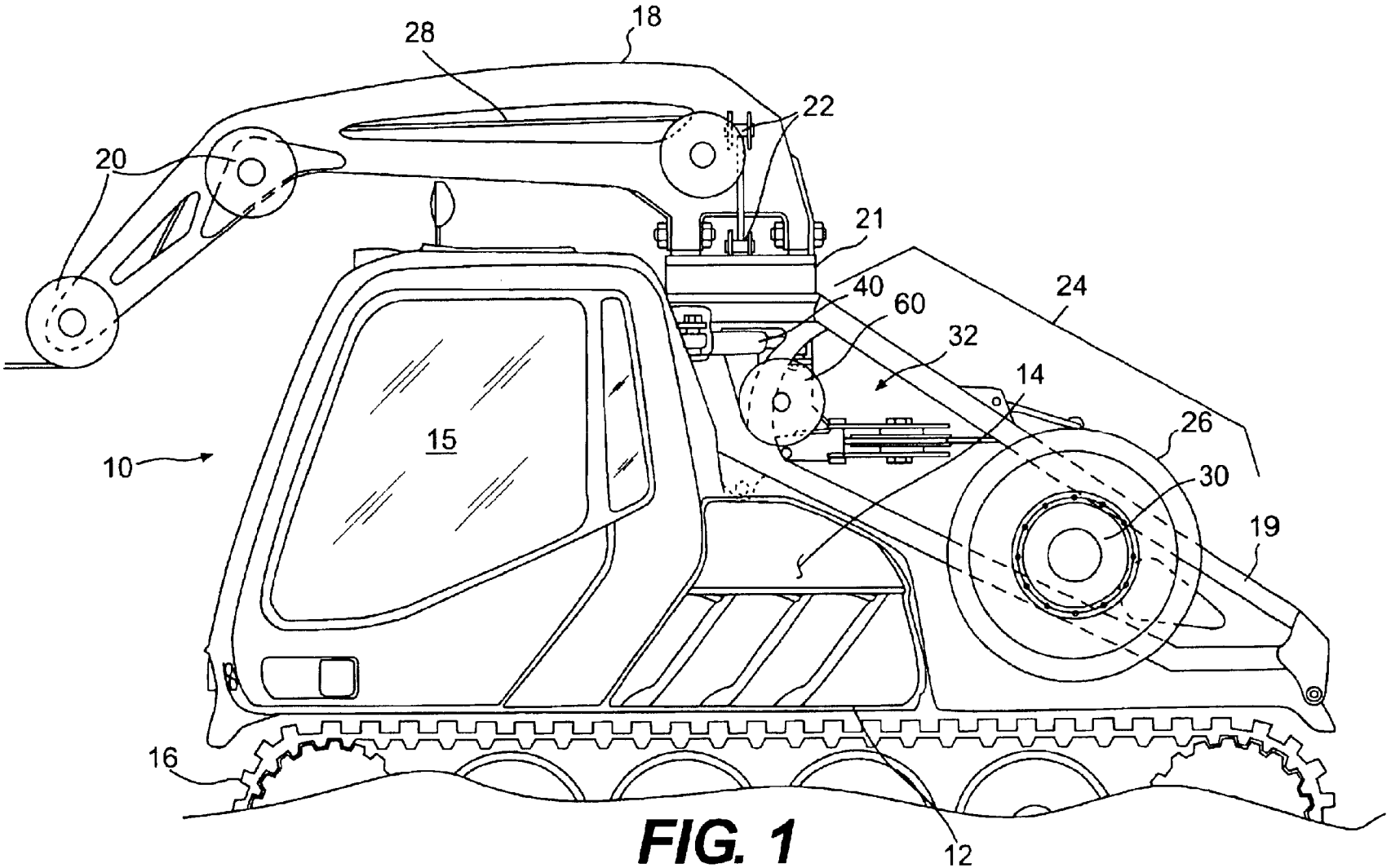
FIG. 1 is a partial view of a tracked vehicle having a winch assembly in accordance with embodiments of the invention.

FIG. 1 illustrates a vehicle 10 of the present invention. The vehicle 10 includes a frame 12, an engine 14 supported by the frame 12, a drive mechanism 16 operatively connected to the engine 14, a winch assembly 24 supported by the frame 12, and a boom 18 supported by the frame 12. A cab 15 for having an operator and vehicle control elements is also supported by the frame 12. In the illustrated embodiment, the engine 14 is not illustrated, but its location is indicated on the frame 12. As would be appreciated by those skilled in the art, the engine 14 need not be positioned in the area indicated. Instead, the engine 14 may be located on the vehicle 10 in any alternative, suitable location.

The frame 12 can be fabricated from materials well known in the art, including but not limited to steel. Fabrication techniques well known in the art can be used to form and assemble the frame 12.

The engine 14 can be any engine typically used in such vehicles. The size of the engine 14 will depend on the size and specific demands of the vehicle 10. Preferably, the engine 14 is an internal combustion engine that can generate a high horse power.

The drive mechanism 16 is operatively connected to the engine 14 so as to move the vehicle 10 across a surface. The drive mechanism 16 allows for the vehicle 10 to move across land, ice, or water. The drive mechanism 16 may comprise an endless track, as illustrated by FIG. 1, wheels, or any component that will allow the vehicle 10 to travel.

The winch assembly 24 is supported on a winch frame 19 that is coupled to the frame 12. The winch assembly 24 includes a drum 26 that carries a length of cable 28, a driver 30 coupled to the drum 26 for rotating the drum 26 to wind and unwind the cable 28, and a level winder 32 disposed at a base portion of the boom 18 and adjacent to the drum 26 to guide the cable 28 with respect to the drum 26.

It is contemplated that the driver 30 is a hydraulic motor that is operatively connected to the engine 14 via a suitable hydraulic system. Of course, as would be appreciated by those skilled in the art, the driver 30 may be mechanically driven by the engine. Alternatively, the driver 30 my be an electrically-driven motor. It should be understood that the driver 30 may be of any type suited for this purpose without departing from the scope and spirit of the invention.

The boom 18 has a guide system that guides the cable 28 outward from (or inward to) the vehicle 10. The guide system includes a series of pulleys 20, a series of rollers 22, or any combination of pulleys 20 and rollers 22. The pulleys 20 are disposed on the boom 18, and the cable 28 is fed around the pulleys 20. The rollers 22 are disposed on the boom 18, and the cable 28 is fed over the rollers 22. The boom 18 is preferably formed of metal and may comprise a pair of parallel beams with the guide system supported therebetween. Alternatively, the boom 18 may be formed of a series of rigid members fixed together as an integral cantilever support. It is noted that the boom 18 may have any other suitable construction without departing from the invention.

As seen in FIG. 1, the boom 18 is supported for movement on a support platform 21 that is supported by the vehicle frame 12, at least in part, via the winch frame 19. Preferably, the boom 18 is supported for rotatable movement with respect to the platform 21 on the winch frame 19. With this arrangement, the boom 18 can be oriented at various directions with respect to the drive mechanism 16 to accommodate different directions of travel. The direction of the boom 18 may be controlled by the operator or may be preset. Alternatively, other mounting structures may be implemented that allow for directional adjustment. It is also possible to use a fixed boom depending on the intended use of the vehicle 10.

The cable 28 is typically metal, such as steel, but may be any material suitable for the intended purpose of the invention. Any known cable 28 capable of withstanding a large load is suitable. The diameter of the cable 28 and type of material are chosen to ensure that the load requirements of the vehicle 10 may be tolerated.

Figure 3:
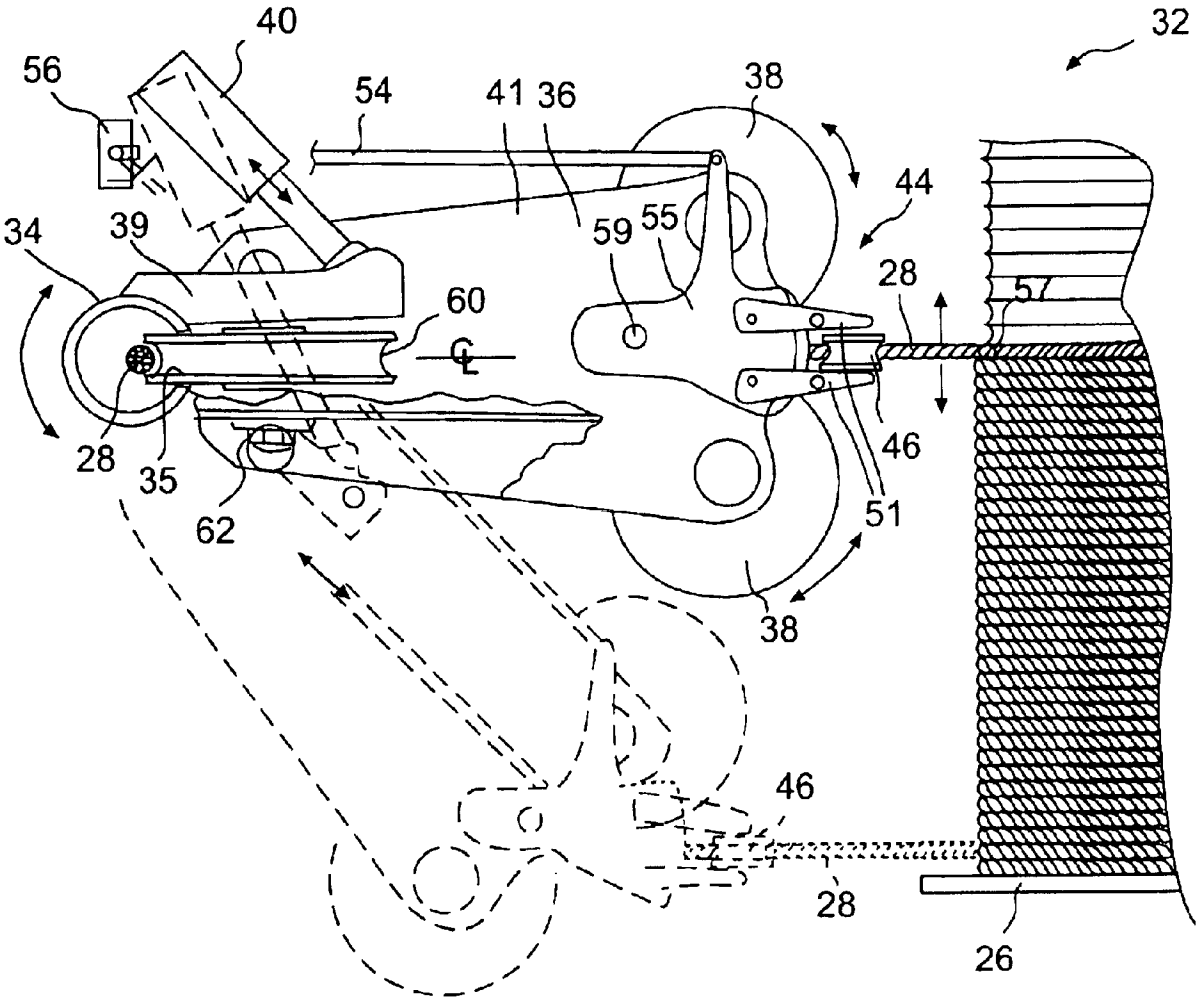
FIG. 3 is a top schematic view of the level winder of FIG. 2.

The drum 26 is mounted on the winch frame 19 such that it rotates about a longitudinal axis. The longitudinal axis is generally horizontal (when the vehicle 10 is supported on a horizontal surface). The drum 26 is sized to ensure that the appropriate amount of cable 28 can be completely wound onto the drum 26. The cable 28 is wound across an outer circumferential surface of the drum 26. The outer circumferential surface of the drum 26 may be smooth or grooved. In the preferred embodiment, the drum 26 is grooved, as illustrated in FIG. 3.

Grooves with the appropriate radius may be formed in the circumferential surface of the drum 26 so that when the cable 28 wraps around the drum, the cable 28 lies in what is essentially one continuous groove. The grooves may be added to the drum 26 by standard fabrication techniques, including but not limited to machining. Spaced grooves around the circumference of the drum 26 allow the cable 28 to be retained in the grooves during winding and unwinding. The grooves provide a tighter, neater, and more compact wind as compared to drums with a smooth surface. This provides for smoother operation and may enhance the life of the cable 28.

The driver 30 is coupled to the drum 26 and rotates the drum 26. The drum 26 rotates in one direction to wind the cable 28 and in the opposite direction to unwind the cable 28. As mentioned above, the driver 30 may be an electric or hydraulic motor, for example. The driver 30 may be operatively connected to the vehicle engine 14 and/or electrical system or may be an independent component. The driver 30 preferably is sized to handle the load created by the drum 26 and the cable 28.

The level winder 32 is disposed adjacent to the drum 26 to guide the cable 28 from the boom 18 with respect to the drum 26. The level winder 32 is supported to move in an arc shaped path and is preferably supported to pivot about a generally vertical axis. The arc shaped path is largely defined by the pivoting of the level winder 32 about the generally vertical axis.

Figure 2:
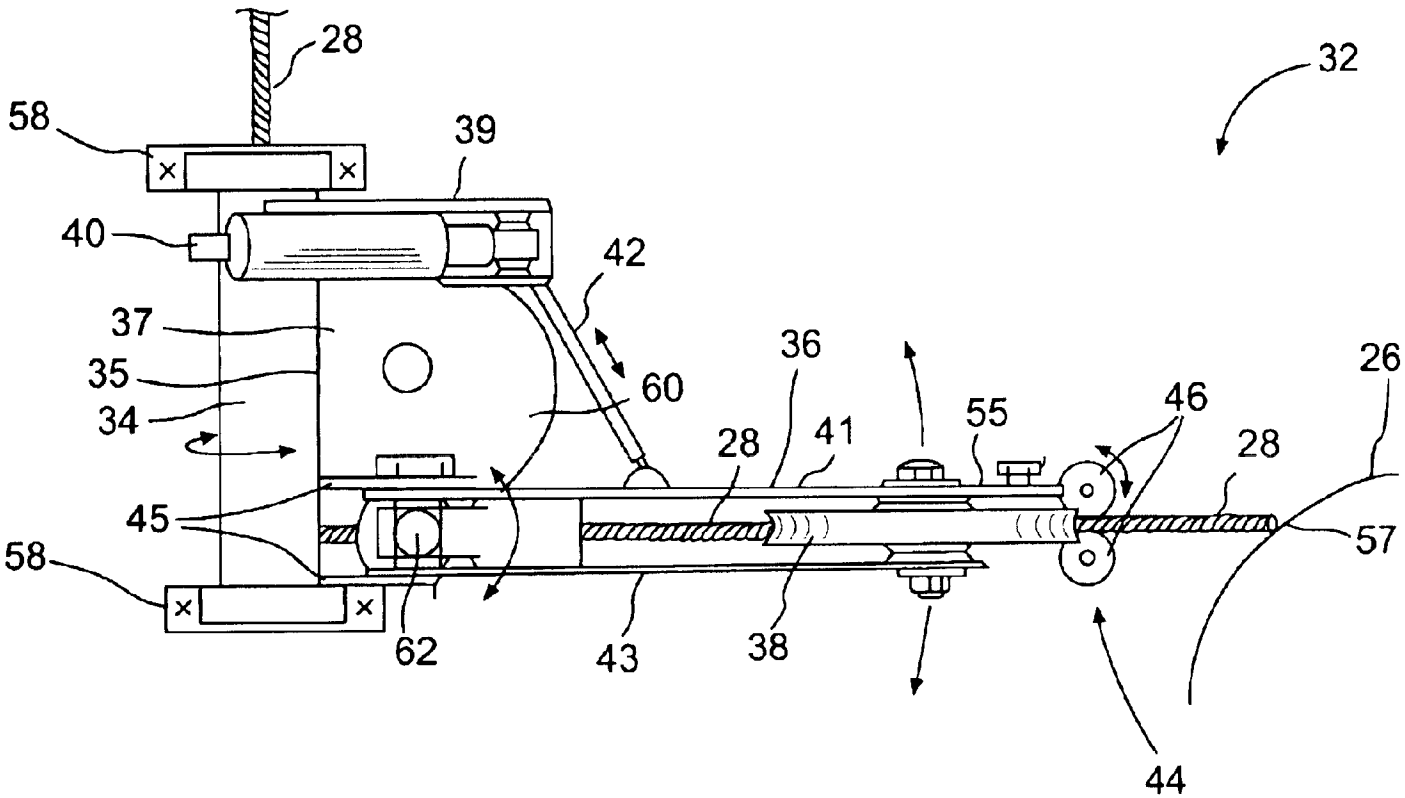
FIG. 2 is an enlarged side view of the level winder illustrated as a part of the tracked vehicle shown in FIG. 1.

As illustrated in FIG. 2 and FIG. 3, the level winder 32 includes a rotatable support 34, a cable support frame 36 that is connected to the rotatable support 34, and a pair of rotatable pulleys 38 carried by the cable support frame 36. The cable support frame 36 pivots with the rotatable support 34. By this, the pair of pulleys 38 pivot with respect to the drum 26.

The rotatable support 34 is mounted on the winch frame 19. The rotatable support 34 is preferably operatively connected to a pair of rotatable support bearings 58. The rotatable support bearings 58 are fixedly attached to the winch frame 19. The rotatable support bearings 58 are connected to opposite ends of the rotatable support 34 so that the rotatable support 34 can freely rotate about a generally vertical axis, while being fixed in the other two directions.

The rotatable support 34 is substantially the shape of a hollow cylinder with at least one slot 35 along the longitudinal length of the cylinder. Of course, any suitable support assembly may be used to allow the level winder 32 to pivot with respect to the drum 26.

The winch assembly 24 further includes a rotatable pulley 60 that is disposed adjacent to the rotatable support 34 such that an outer edge of the rotatable pulley 60 lies within the slot 35 of the rotatable support 34. The rotatable pulley 60 is disposed between two substantially parallel support plates 37. The support plates 37 are fixedly attached to the rotatable support 34 such that the support plates 37 rotate with the rotatable support 34 about a generally vertical axis. The rotatable pulley 60 is mounted to the support plates 37 such that the rotatable pulley 60 can freely rotate about its generally horizontal axis. The rotatable pulley 60 directs the cable 28 from the boom 18 to the level winder 32. The rotatable pulley 60 has a radius greater than or equal to the minimum recommended bending radius of the cable 28.

The level winder 32 further includes at least one actuator 40 that is coupled to the rotatable support 34. In the preferred embodiment, one upper bracket 39 is mounted to each support plate 37, preferably above the axis of the rotatable pulley 60. One end of the actuator 40 is pivotally attached to the upper bracket 39. The opposite end of the actuator 40 is pivotally attached to the winch frame 19, as seen in FIG. 1, and is in communication with a proximity switch 56. Preferably, the actuator 40 is a hydraulic or pneumatic cylinder. Upon activation, the actuator 40 extends or retracts to push or pull the support plates 37, which in turn rotates the rotatable pulley 60, the rotatable support 34, and the cable support frame 36. As will be discussed below, this causes the pair of pulleys 38 to pivot with respect to the drum 26 to maintain the cable 28 in a predetermined position relative to the drum 26. The desired predetermined position relative to the drum 26 is generally perpendicular, in this case.

Figure 4:
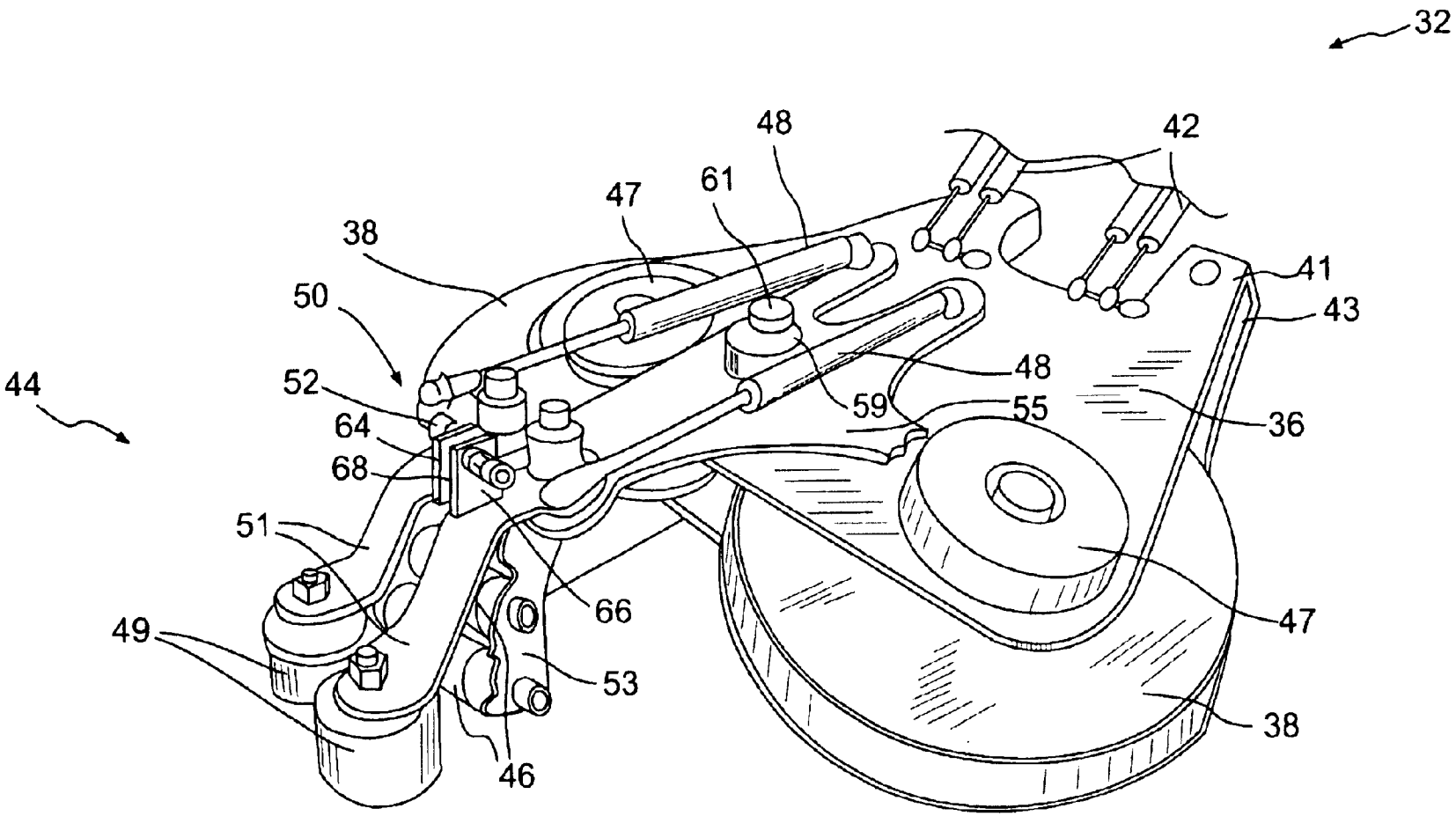
FIG. 4 is a side perspective view of the level winder of FIG. 2.
Figure 5:
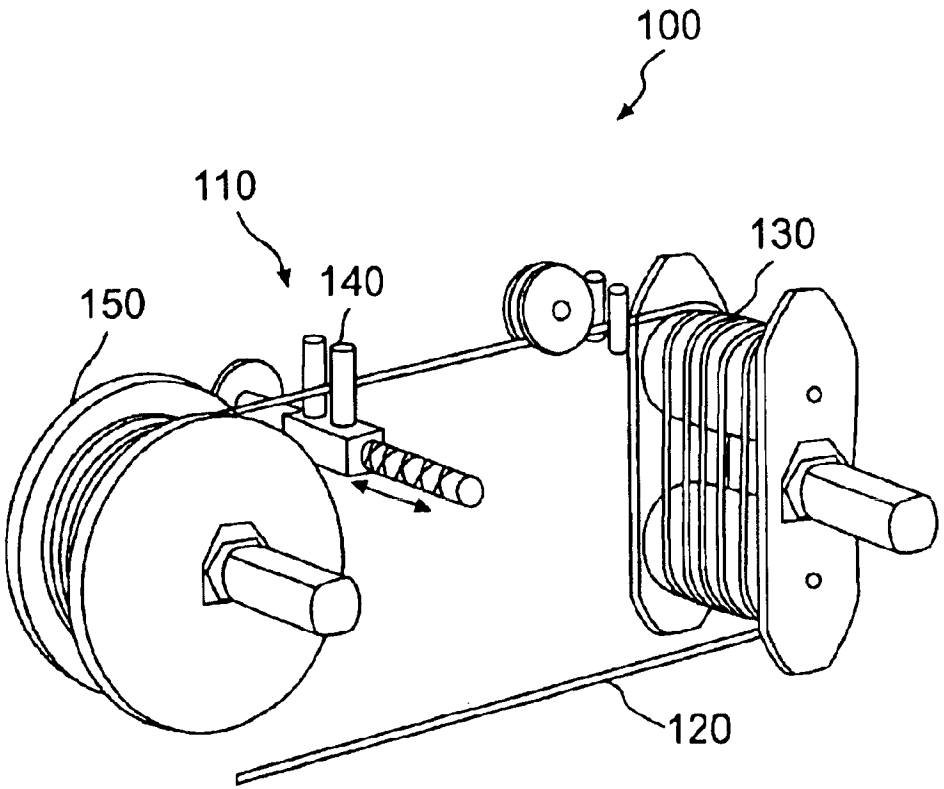
FIG. 5 PRIOR ART
FIG. 5 is a view of a prior art capstan cable winding system.

Referring to FIGS. 2–4, the cable support frame 36 includes an upper plate 41 and a lower plate 43 that are substantially parallel to one another. The cable support frame 36 has a longitudinal centerline CL that extends in a direction from the rotatable support 34 towards the drum 26. Each support plate 37 further includes a pair of lower brackets 45 that are fixedly attached to the support plate 37 below the axis of the rotatable pulley 60. The lower brackets 45 in each pair are spaced such that the cable support frame 36 can be disposed therebetween. A pair of level winder ball bearings 62 are disposed within the cable support frame 36 on opposite sides of the longitudinal centerline CL. The level winder ball bearings 62 are mounted and oriented in such a way as to create a generally horizontal axis. The level winder ball bearings 62 allow the cable support frame 36 to rotate within a fixed range about a generally horizontal axis.

A biasing mechanism 42 is coupled between the cable support frame 36 and the top of the support plates 37, preferably at the upper brackets 39. The biasing mechanism 42 maintains the cable support frame 36 in a predetermined position relative to the rotatable support 34. The predetermined position relative to the rotatable support 34 is generally perpendicular. The biasing mechanism 42 can include a spring that retains the cable support frame 36 in a relatively horizontal position. Of course, any biasing mechanism can be used, including a resilient cable or hydraulic or pneumatic cylinder. By this construction, the cable support frame 36 can move slightly up or down with respect to the surface of the drum 26 to accommodate the thickness of the cable 28 wound on the drum 26.

At the opposite end of the cable support frame 36, the pair of pulleys 38 are disposed between the upper plate 41 and the lower plate 43 on opposite sides of the longitudinal centerline CL of the cable support frame 36. The pair of pulleys 38 are connected to the cable support frame 36 with pulley bearings 47. The pulleys 38 are generally oriented in the same plane and are spaced so that the cable 28 can pass between them. The centers of the pulleys 38 are aligned on an axis that is generally perpendicular to the longitudinal centerline CL of the cable support frame 36.

The level winder 32 further includes a feeding mechanism 44 that is pivotally supported by the cable support frame 36. The feeding mechanism 44 controls the tension and direction of the cable 28 as the cable 28 is fed from the pulleys 38 to the drum 26. An embodiment of the feeding mechanism 44 is illustrated in detail in FIG. 4. The feeding mechanism 44 includes a pivot arm 55, a pair of guiding rollers 46, and a pair of tensioning rollers 49.

In the preferred embodiment, the pivot arm 55 is disposed above the upper support plate 41 of the cable support frame 36 such that the pivot arm 55 and the cable support frame 36 extend in substantially parallel planes to one another. The pivot arm 55 is pivotally connected to the cable support frame 36 with a bearing 59 and a fastener 61 at a position along the longitudinal centerline CL of the cable support frame 36. The pivot arm 55 has a first end and a second end. The first end of the pivot arm 55 extends beyond the cable support frame 36 in the direction towards the drum 26.

The guiding rollers 46 are attached between a pair of roller support brackets 53 with bearings and fasteners. The roller support brackets 53 are fixedly attached to the first end of the pivot arm 55 and extend generally downward in such a manner that they do not interfere with the pair of pulleys 38. The guiding rollers 46 are generally aligned in a vertical plane and are spaced and shaped such that the cable 28 can fit snugly between them.

The pair of tensioning rollers 49 are disposed at one end of a pair of cantilever brackets 51. The cantilever brackets 51 each have a first end and a second end. The first ends of the cantilever brackets 51 are pivotally connected to the first end of the pivot arm 55 with bushings and fasteners. The second ends of the cantilever brackets 51 extend away from the pivot arm 55 and cable support frame 36 towards the drum 26. The tensioning rollers 49 are connected to the second ends of the cantilever brackets 51 with bearings and fasteners. Preferably, the tensioning rollers 49 and the guiding rollers 46 are oriented such that their axes of rotation are perpendicular to one another. For example, in the preferred embodiment, the guiding rollers 46 rotate about generally horizontal axes and the tensioning rollers 49 rotate about generally vertical axes (when the vehicle 10 is supported on a horizontal surface). Alternatively, the guiding rollers 46 may rotate about generally vertical axes and the tensioning rollers 49 may rotate about generally horizontal axes (when the vehicle 10 is supported on a horizontal surface).

The feeding mechanism 44 further includes a pressure controller 48. The pressure controller 48 is coupled to the tensioning rollers 49 to control the pressure between the tensioning rollers 49 to control feeding of the cable 28. Preferably, the pressure controller 48 includes a hydraulic cylinder. Alternatively, the pressure controller 48 may include a pneumatic cylinder or any other resilient device. In the preferred embodiment, the pressure controller 48 includes a pair of hydraulic cylinders, as illustrated in FIG. 4.

The feeding mechanism 44 further includes a sensitivity controller 50. The sensitivity controller 50 is coupled to the tensioning rollers 49 to adjust the distance between the tensioning rollers 49. Preferably, the sensitivity controller 50 includes a first plate 64 mounted to one of the cantilever brackets 51 and a second plate 66 mounted to the other cantilever bracket 51. A third plate 68 is disposed in between the cantilever brackets 51 and is fixedly attached to the pivot arm 55. The sensitivity controller 50 further includes a pair of adjustment screws 52. The adjustment screws 52 are used to set a gap between the first plate 64 and the third plate 66 and a gap between the second plate 68 and the third plate 66.

As the adjustment screws 52 are tightened, the cantilever brackets 51 are pushed away from each other, thereby increasing the gap between the tensioning rollers 49, which decreases the sensitivity to changes in the position of the cable 28. Conversely, as the adjustment screws 52 are loosened, the cantilever brackets 51 will by drawn towards each other due to the pressure exerted by the pressure controller 48. This in turn will decrease the gap between the tensioning rollers 49, which increases the sensitivity to changes in the position of the cable 28.

The feeding mechanism 44 further includes a position actuator 54 that is operatively coupled to the proximity switch 56 that activates the actuator 40 to pivot the level winder 32. A first end of the position actuator 54 is pivotally connected to the pivot arm 55. A second end of the position actuator 54 is pivotally connected to the proximity switch 56. When the feeding mechanism 44 pivots beyond a certain predetermined position, the position actuator 54 signals the proximity switch 56. The proximity switch 56 activates movement of the level winder 32 along the arc shaped path by signaling the actuator 40. Any known type of proximity switch or position detector may be used.

In operation, the cable 28 starts in a fully wound position on the drum 26. The cable 28 is fed from the drum 26 through the level winder 32, through the rotatable support 34, through the guide system within the boom 18, and out one end of the boom 18. The cable 28 is secured to a predetermined anchor point located on the terrain and the vehicle 10 moves away from the anchor point via the drive mechanism 16. In order for the vehicle 10 to move away from the anchor point, the cable 28 must be lengthened or "played out" from the drum 26. The driver 30 rotates the drum 26 such that the cable 28 unwinds from the drum 26, thereby allowing the cable 28 to lengthen.

As the cable unwinds from the drum 26, it releases from the drum at a release point 57. The release point 57 moves parallel to the longitudinal axis of the drum 26 as the drum 26 rotates. The level winder 32 pivots in an arc such that the feeding mechanism 44 is substantially aligned with the release point 57. This ensures that the cable 28 is generally perpendicular to the drum 26 at the release point 57 so that the cable does not twist or kink.

After the cable 28 releases from the drum 26, the cable 28 passes in between the pair of tensioning rollers 49. As the location of the release point 57 changes, the cable 28 exerts a greater pressure against one of the tensioning rollers 49. When the resulting pressure on the pressure controller 48 exceeds a predetermined value, the pivot arm 55 pivots just enough to keep the cable 28 perpendicular to the drum 26. When the pivot arm 55 reaches a maximum pivot point, the position actuator 54 activates the proximity switch 56. The proximity switch 56 then signals the actuator 40. The actuator 40 rotates the level winder 32 along an arc shaped path in the direction that the cable 28 is extending toward the drum 26. As the level winder 32 rotates, the pivot arm 55 is drawn by the cable 28 to rotate independently to ensure the cable 28 remains perpendicular to the drum 26. These adjustments by the feeding mechanism 44 are constantly repeated while the winch assembly 24 is in operation.

After the cable 28 passes through the tensioning rollers 49, the cable 28 passes in between the guiding rollers 46. The guiding rollers 46 ensure that the cable 28 is properly lined up to pass in between the pair of pulleys 38, regardless of the amount of tension in the cable 28. Once the cable 28 passes the pair of pulleys 38, it travels through the cable support frame 36 and onto the rotatable pulley 60. The rotatable pulley 60 feeds the cable 28 though the rotatable support 34 to the pulleys 20 and rollers 22 located in the guide system in the boom 18.

To drive the vehicle 10 in a reverse direction towards the anchor point, the rotation of the drum 26 must be reversed by the driver 30 so that any slack in the cable 28 can be tightened. In other words, the cable 28 must be rewound onto the drum 26. Further, the vehicle 10 may need the power of the winch assembly 24 help pull the vehicle 10 back towards the anchor point. The level winder 32 operates in the same manner as was described above, only the cable 28 moves in the opposite direction and the pulleys 20, 60, 38 and rollers 22, 46, 49 rotate in the opposite direction.

Due to the relatively compact design of the level winder 32, the operator of the vehicle 10 can watch the winding process to ensure that the cable 28 is being properly unwound and wound, because the level winder 32 does not obstruct the view of the drum 26.

It will be understood that the invention encompasses various modifications and alterations to the precise operating systems. For example, although the system is described for use in a heavy duty cable winding assembly, other windable materials may be used in the device, and the device may be adapted for use in smaller manufacturing environments.

What is claimed is:

1. A winch assembly comprising:

a drum that carries a length of cable, the drum having an axis of rotation;

a driver coupled to the drum for rotating the drum to wind and unwind the cable;

a level winder disposed adjacent to the drum to guide the cable with respect to the drum, wherein the level winder is supported to move in an arc-shaped path, a rotatable support;

a cable support frame connected to the rotatable support;

an actuator coupled to the rotatable support that pivots the cable support frame with respect to the drum to maintain the cable in a predetermined position relative to the drum; and a biasing mechanism coupled to the cable support frame that maintains the cable support frame in a predetermined position relative to the rotatable support, wherein the level winder includes a pair of pulleys, each pulley having an axis of rotation, and wherein the axis of rotation of each of the pulleys moves in an arc-shaped path with respect to the axis of rotation of the drum, and wherein the pair of pulleys are carried by the cable support frame such that the pair of pulleys pivot with respect to the drum about the rotatable support.

2. A winch assembly comprising:

a drum that carries a length of cable, the drum having an axis of rotation;

a driver coupled to the drum for rotating the drum to wind and unwind the cable;

a level winder disposed adjacent to the drum to guide the cable with respect to the drum, wherein the level winder is supported to move in an arc-shaped path, a rotatable support; and a cable support frame connected to the rotatable support, wherein the level winder includes a pair of pulleys, each pulley having an axis of rotation, and wherein the axis of rotation of each of the pulleys moves in an arc-shaped path with respect to the axis of rotation of the drum, wherein the pair of pulleys are carried by the cable support frame such that the pair of pulleys pivot with respect to the drum about the rotatable support, wherein the level winder further includes a feeding mechanism pivotally supported by the cable support frame through which the cable is fed from the pulleys, and wherein the feeding mechanism includes a pair of rollers and a pressure controller coupled to the rollers to control pressure between the rollers to control feeding of the cable.

3. The winch assembly of claim 2, wherein the feeding mechanism further includes a sensitivity controller coupled to the rollers to adjust the distance between the rollers.

4. A winch assembly comprising:

a drum that carries a length of cable, the drum having an axis of rotation;

a driver coupled to the drum for rotating the drum to wind and unwind the cable;

a level winder disposed adjacent to the drum to guide the cable with respect to the drum, wherein the level winder is supported to move in an arc-shaped path, a rotatable support; and a cable support frame connected to the rotatable support, wherein the level winder includes a pair of pulleys, each pulley having an axis of rotation, and wherein the axis of rotation of each of the pulleys moves in an arc-shaped path with respect to the axis of rotation of the drum, wherein the pair of pulleys are carried by the cable support frame such that the pair of pulleys pivot with respect to the drum about the rotatable support, wherein the level winder further includes a feeding mechanism pivotally supported by the cable support frame through which the cable is fed from the pulleys, and wherein the feeding mechanism includes a position actuator operatively connected to a proximity switch, wherein when the feeding mechanism pivots beyond a certain position the proximity switch activates movement of the level winder along the arc-shaped path.

5. A winch assembly comprising:

a drum that carries a length of cable, the drum having an axis of rotation;

a driver coupled to the drum for rotating the drum to wind and unwind the cable;

a level winder disposed adjacent to the drum to guide the cable with respect to the drum, wherein the level winder is supported to move in an arc-shaped path, a rotatable support; and a cable support frame connected to the rotatable support, wherein the level winder includes a pair of pulleys, each pulley having an axis of rotation, and wherein the axis of rotation of each of the pulleys moves in an arc-shaped path with respect to the axis of rotation of the drum, wherein the pair of pulleys are carried by the cable support frame such that the pair of pulleys pivot with respect to the drum about the rotatable support, wherein the level winder further includes a feeding mechanism pivotally supported by the cable support frame through which the cable is fed from the pulleys, and wherein the feeding mechanism is operatively coupled to a proximity switch that activates an actuator to pivot the level winder.

6. A winch assembly comprising:

a drum that carries a length of cable;

a driver coupled to the drum for rotating the drum about a first axis to wind and unwind the cable;

an actuator coupled to the rotatable support that pivots the cable support frame with respect to the drum to maintain the cable in a predetermined position relative to the drum;

a biasing mechanism coupled to the cable support frame that maintains the cable support frame in a predetermined position relative to the rotatable support; and a level winder disposed adjacent to the drum to guide the cable with respect to the drum, wherein the level winder is supported to pivot about a second axis, the second axis being perpendicular to the first axis, wherein the level winder includes a rotatable support, a cable support frame connected to the rotatable support, and a pair of pulleys carried by the cable support frame, such that the pair of pulleys move in an arc-shaped path.

7. The winch assembly of claim 6, wherein the level winder further comprises a feeding mechanism pivotally supported by the cable support frame through which the cable is fed from the pulleys.

8. The winch assembly of claim 7, wherein the feeding mechanism includes a pair of rollers and a pressure controller coupled to the rollers to control pressure between the rollers to control feeding of the cable.

9. The winch assembly of claim 7, wherein the feeding mechanism includes a position actuator operatively connected to a proximity switch, wherein when the feeding mechanism pivots beyond a certain position the proximity switch activates movement of the level winder along an arc-shaped path.

10. A vehicle, comprising:

a frame, an engine supported by the frame, and a drive mechanism operatively connected to the engine;

a winch assembly supported by the frame including a drum that carries a length of cable, a driver coupled to the drum for rotating the drum to wind and unwind the cable;

an actuator coupled to the rotatable support that pivots the cable support frame with respect to the drum to maintain the cable in a predetermined position relative to the drum;

a biasing mechanism coupled to the cable support frame that maintains the cable support frame in a predetermined position relative to the rotatable support, and a level winder disposed adjacent to the drum to guide the cable with respect to the drum, wherein the level winder is supported to move in an arc-shaped path, wherein the level winder includes a rotatable support, a cable support frame connected to the rotatable support, and a pair of pulleys carried by the cable support frame, such that the pair of pulleys move in an arc-shaped path with respect to the drum.

11. The vehicle of claim 10, wherein the level winder further comprises a feeding mechanism pivotally supported by the cable support frame through which cable is fed from one of the pulleys.

12. The vehicle of claim 11, wherein the feeding mechanism includes a pair of rollers and a pressure controller coupled to the rollers to control pressure between the rollers to control feeding of the cable.

13. The vehicle of claim 11, wherein the feeding mechanism includes a position actuator operatively connected to a proximity switch, wherein when the feeding mechanism pivots beyond a certain position the proximity switch activates movement of the level winder along the arc-shaped path.

14. The vehicle of claim 11, wherein the feeding mechanism is operatively coupled to a proximity switch that activates an actuator to pivot the level winder.

* * * * *